US006454151B1

(12) United States Patent
Wang-Kuan

(10) Patent No.: US 6,454,151 B1
(45) Date of Patent: Sep. 24, 2002

(54) POWER STAPLER

(76) Inventor: Lin Wang-Kuan, 11F-2, No. 43, Chai-I Street, Taichung City (TW)

( * ) Notice: Subject to any disclaimer, the term of this patent is extended or adjusted under 35 U.S.C. 154(b) by 79 days.

(21) Appl. No.: 09/617,824

(22) Filed: Jul. 17, 2000

(51) Int. Cl.[7] ..... B25C 1/04
(52) U.S. Cl. ..... 227/8; 227/142
(58) Field of Search ..... 227/8, 130, 148, 227/142

(56) References Cited

U.S. PATENT DOCUMENTS 3,558,032 A * 1/1971 Oefinger ..... 227/8
5,484,094 A * 1/1996 Gupta ..... 227/8
5,649,661 A * 7/1997 Masuno et al. ..... 227/8
5,683,024 A * 11/1997 Eminger et al. ..... 227/136
6,145,723 A * 11/2000 Gupta ..... 227/8
6,286,742 B1 * 9/2001 Mukoyama ..... 227/8

* cited by examiner

*Primary Examiner*—Scott A. Smith
(74) *Attorney, Agent, or Firm*—Charles E. Baxley

(57) ABSTRACT

A power stapler includes a body with a barrel and a handle is connected to the body by a connection plate. The handle has an open bottom end and an end member is engaged with the open bottom end. A connection portion extends from the handle and a magazine is connected between the connection portion and the barrel. The connection portion has a groove for receiving an L-shaped wrench. A safety device is connected to the barrel and has a collar which is threadedly connected to a base member of the safety device so that the collar can be rotated to adjust a distance between the collar and the object.

10 Claims, 16 Drawing Sheets

POWER STAPLER

FIELD OF THE INVENTION

The present invention relates to a power stapler which has a length adjustable nose piece, assemble handle and an end member connected to an end of the handle.

BACKGROUND OF THE INVENTION

A conventional power stapler is shown in FIG. 1 and generally includes a body 10 with a barrel 100 extending from the body 10. A safety device 13 is received in the barrel 100 and is able to actuate a trigger means 11 to a ready-for-shoot status. A handle 101 is integrally connected to the body 10 and has a passage 102 defined therein. A magazine 14 is connected between the handle 101 and the barrel 100 so as to receive nails therein. A fitting of a hose 17 is connected to the handle 101 so that pressurized air is sent into the passage 102 in the handle 101 to eject a nail in the magazine 14. The body 10 and the handle 101 are made of cast iron so that it is so heavy and is not convenient to be used. When nailing nails into an object, the nose piece is pushed against the object so as to put the trigger means 11 to a ready status. Because the power stapler is heavy in weight and only one point contacts against the object so that it is difficult to nail the object at even distance. Furthermore, the safety device 13 is not adjustable so that the conventional power stapler can only use a fix-sized nails.

The present invention intends to provide a power stapler which has a separated handle made of light material and an adjustable nose piece so as to adjust a distance that a line of the safety device can be moved to touch a trigger means.

SUMMARY OF THE INVENTION

In accordance with one aspect of the present invention, there is provided a power stapler and comprising a body with a barrel and a trigger means. A handle is connected to the body by bolt and a magazine is connected between the handle and the barrel. A safety device is connected to the barrel and includes a base member, a spring biased between the body and a first end of the base member, and a link connected to the base member and contacting the trigger means. A ring is connected to a second end of the base member and a collar is movably connected to the ring so that when adjusting the collar, a distance between the barrel and the object to be nailed is adjusted.

The primary object of the present invention is to provide a power stapler which has a handle light in weight. The handle is connected to the body by a connection plate and bolts.

Another object of the present invention is to provide a power stapler which has an end member connected to the handle by a pin and an L-shaped wrench is received in a connection portion extending from the handle.

Yet another object of the present invention is to provide a power stapler which has a safety device and a distance between the barrel and the object to be nailed can be adjusted.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 12 is a cross sectional view to show the safety device on the barrel of the power stapler of the present invention;

DETAILED DESCRIPTION OF THE PREFERRED EMBODIMENTS

Figure 1:
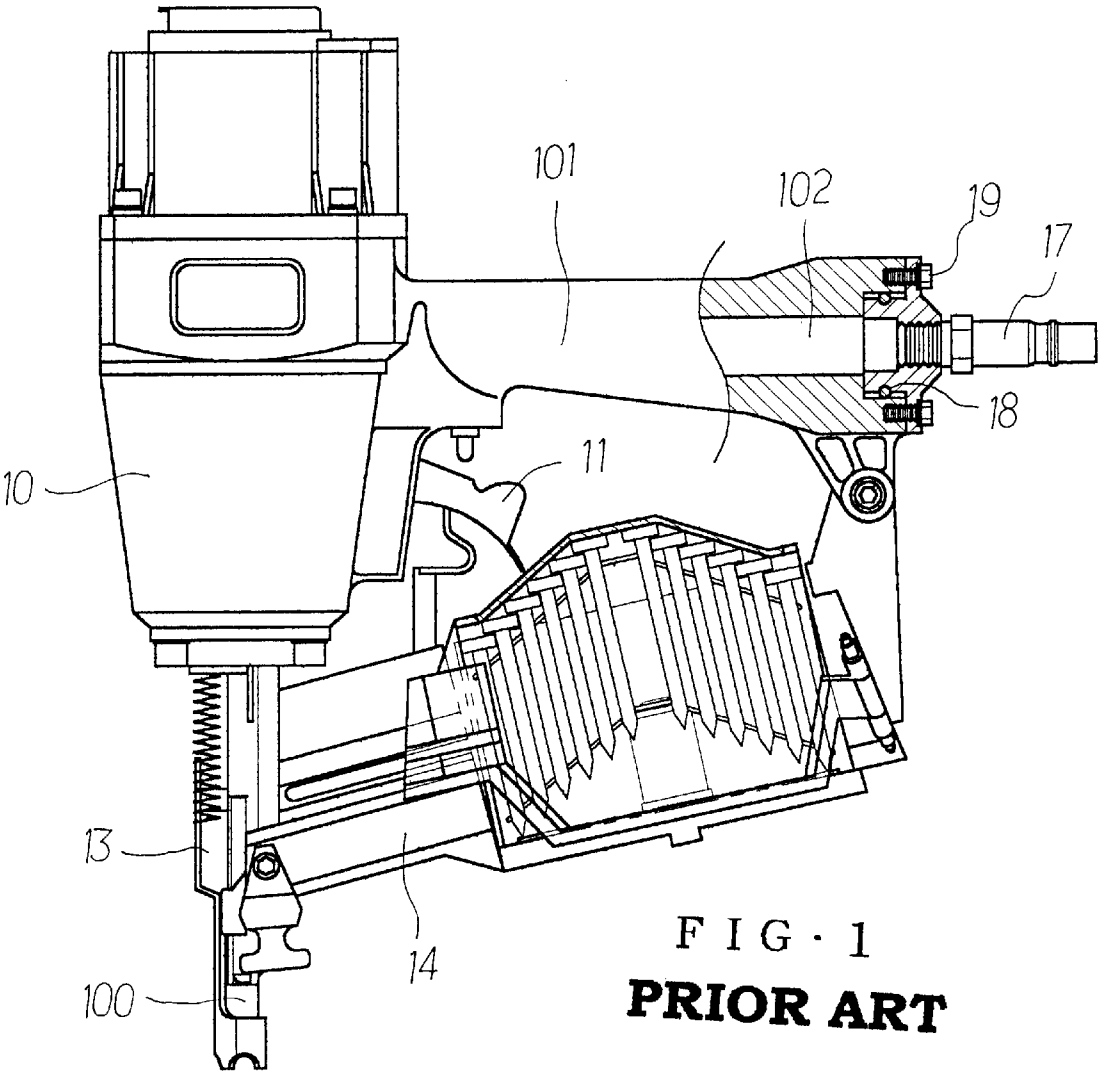
FIG. 1 PRIOR ART
FIG. 1 is a cross sectional view to show a conventional power stapler.
Figure 4:
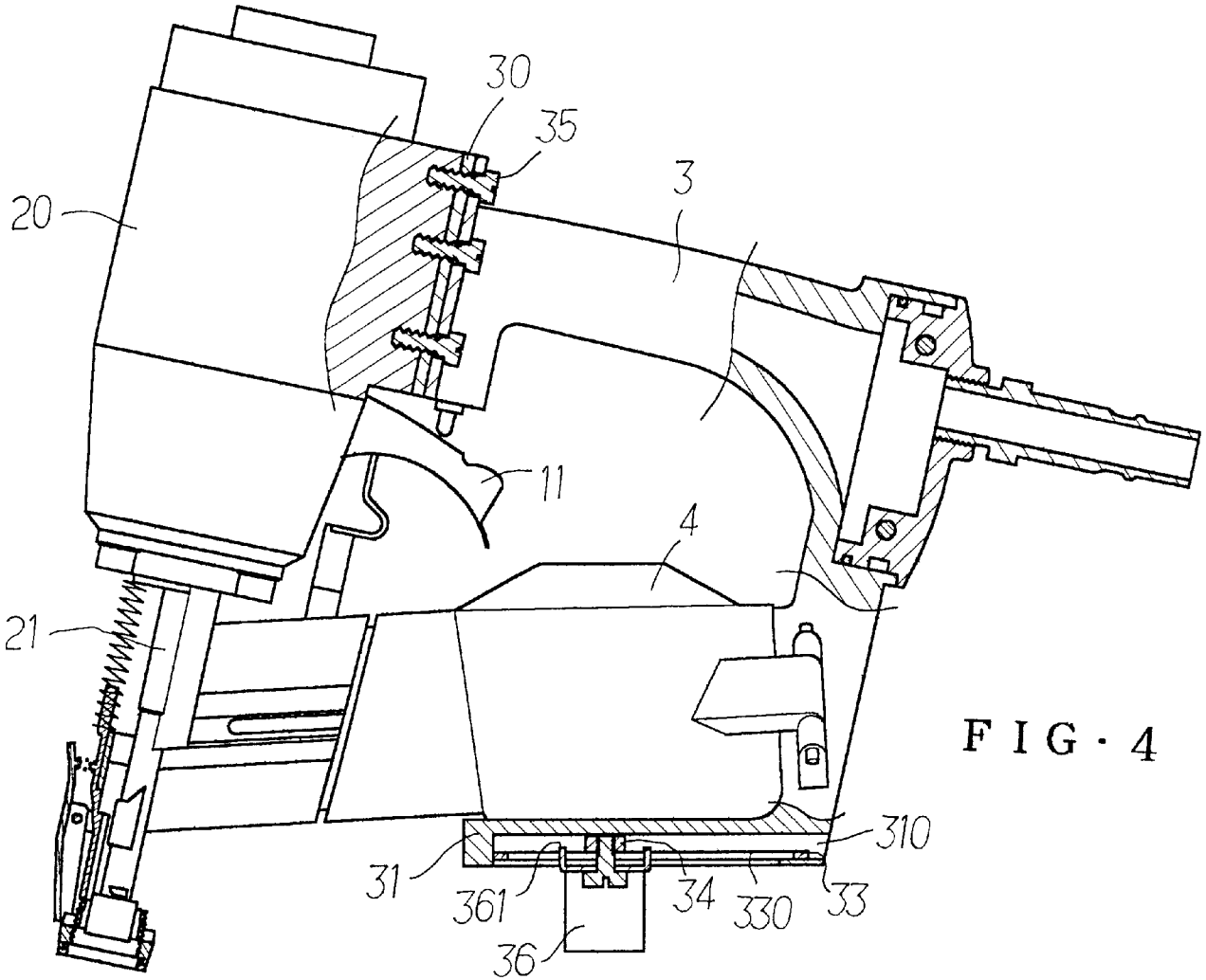
FIG. 4 is a cross sectional view to show the power stapler of the present invention.
Figure 8:
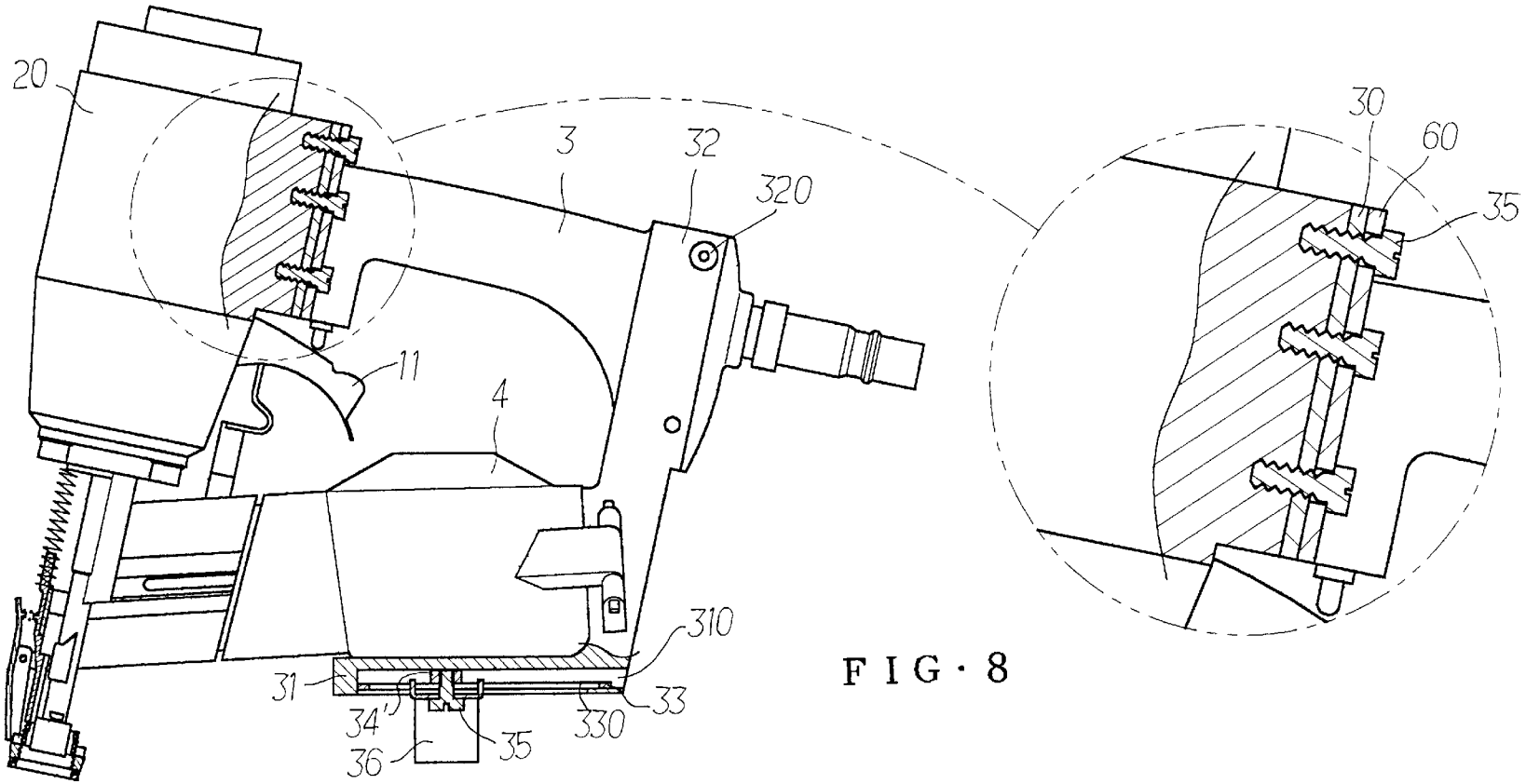
FIG. 8 is a cross sectional view to show the connection between a body and a handle of the power stapler of the present invention.
Figure 9:
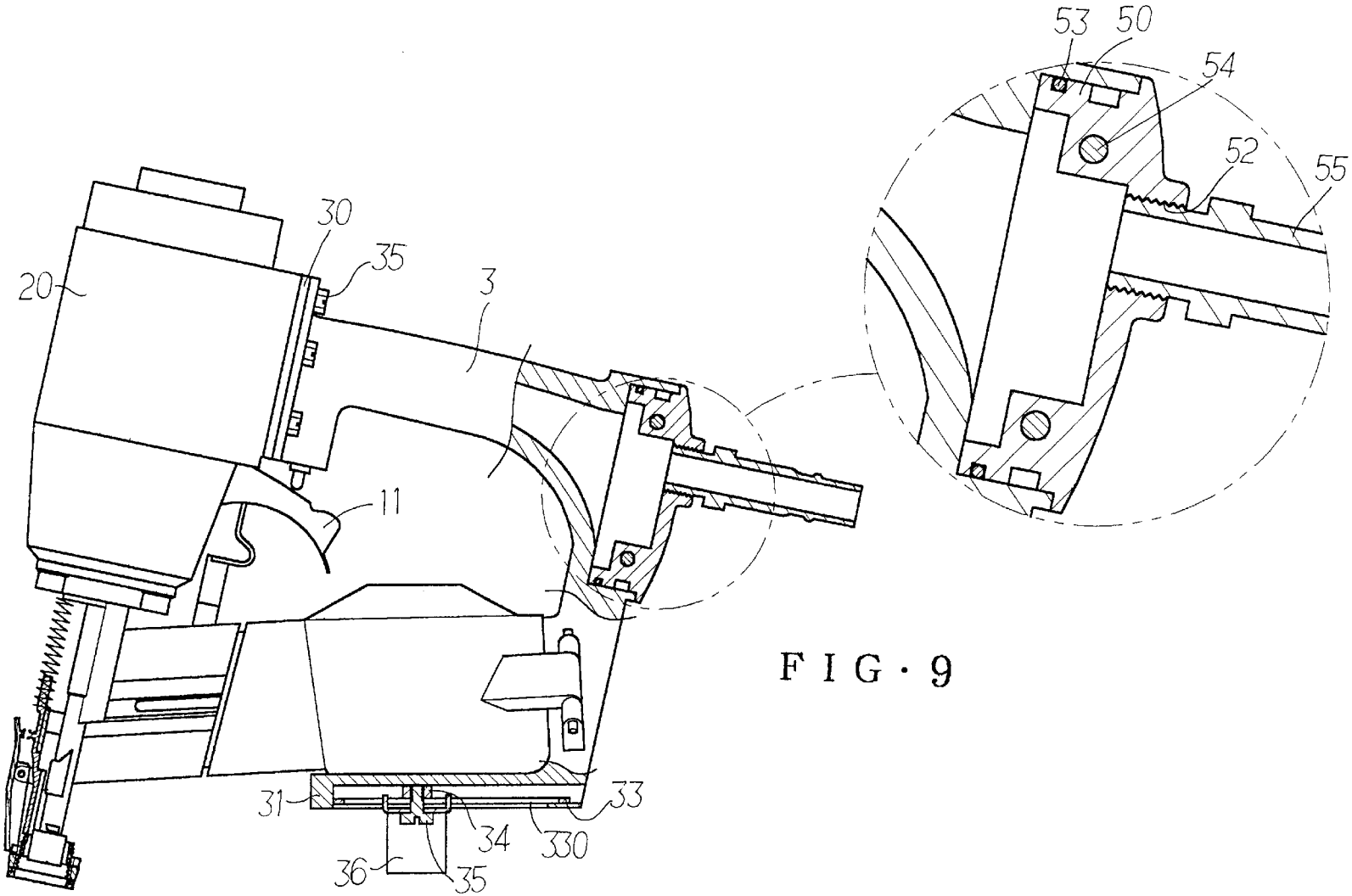
FIG. 9 is a cross sectional view to show the connection between the handle and an end member of the power stapler of the present invention.
Figure 10:
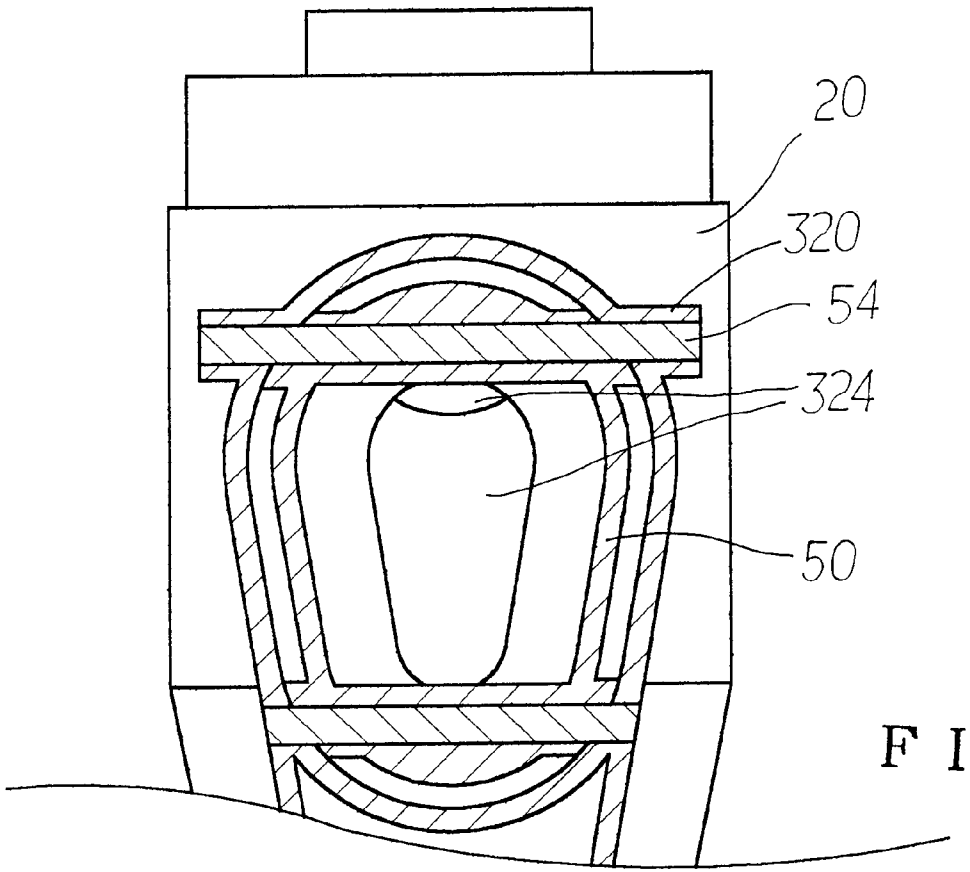
FIG. 10 is a cross sectional view to show a pin connecting the end member to the handle of the power stapler of the present invention.

Referring to FIGS. 1, 4 and 8, the power stapler of the present invention comprises a body 20 with a barrel 21 extending therefrom and a trigger means 11 is connected to the body 20. A safety device 7 is connected to the barrel 21 and has a link 70 which contacts the trigger means 11. A plurality of threaded holes 201 are defined in an underside of the body 20. A handle 3 has flange 30 extending radially from a top end thereof and a plurality of first holes 301 are defined through the flange 30. A U-shaped connection plate 60 is mounted to the handle 3 and has a plurality of second holes 601 defined therethrough. The handle 3 is fixedly connected to the body 20 by extending bolts 35 through the second holes 601, the first holes 301 and engaged with the threaded holes 201 as shown in FIG. 8. The connection plate 60 is made of highly structured material and the handle 3 can be made by light material so as to reduce total weight of the stapler. The handle 3 is connected to the body 20 and an open end 323 is defined in a bottom of the handle 3. A passage 324 defined longitudinally in the handle 3 and two tubes 320 extend radially from the handle 3. Each of the tube 320 has a first positioning hole 321 defined therethrough and the first positioning holes 321 communicate with the passage 324. An end member 5 has a skirt portion 50 which is inserted in the open end 323 and a seal 53 is mounted to the skirt portion 50. Two second positioning holes 51 are defined through the skirt portion 50 and a pin 54 extends through the first positioning holes 321 and the second positioning holes 51 to connect the end member 5 to the handle 3 as shown in FIGS. 9 and 10. A threaded hole 52 is defined through the end member 5 so as to be connected with a hose 55 such that pressurized air can be sent into the passage 324 via the hose 55.

Figure 3:
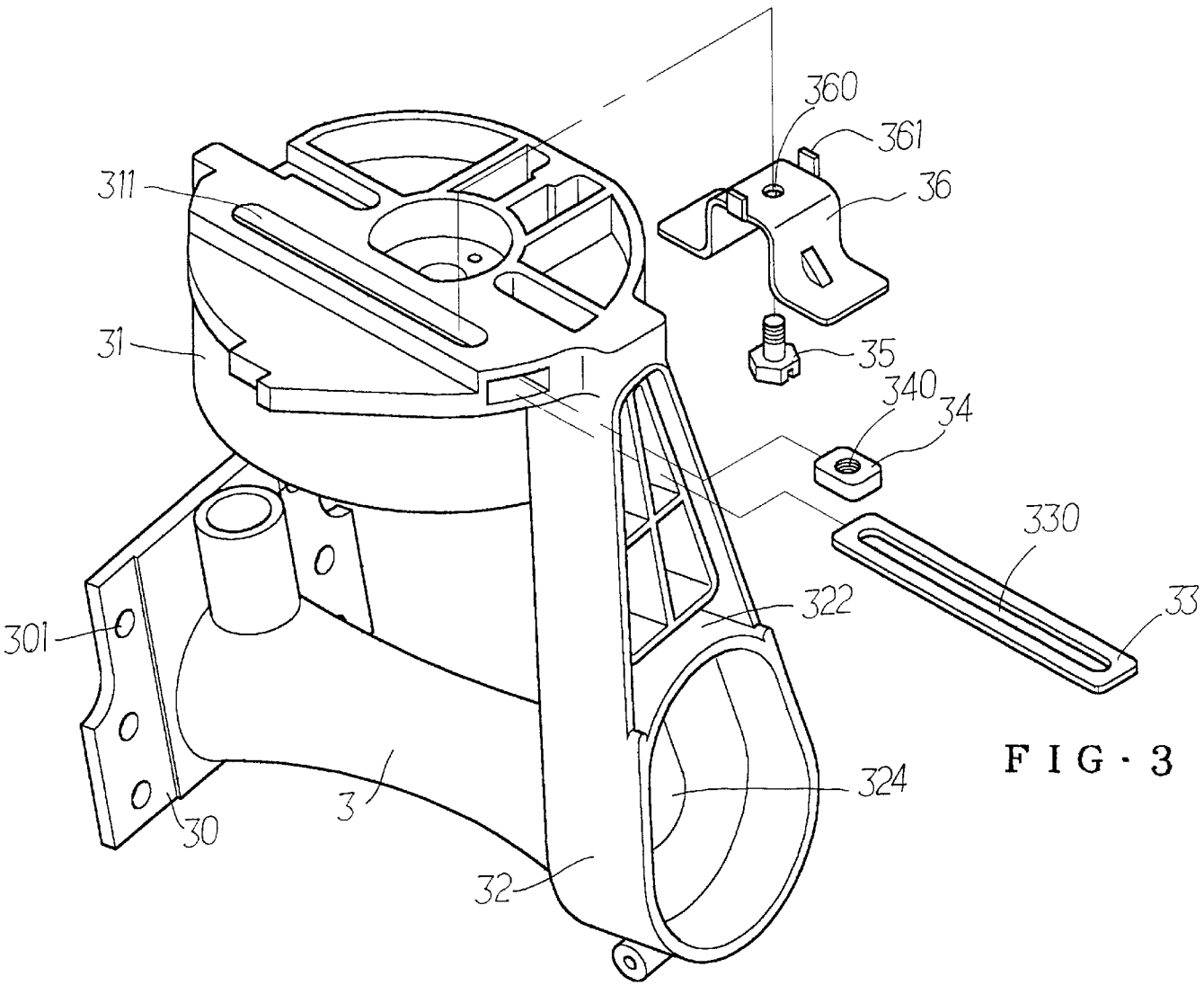
FIG. 3 is an exploded view to show a guide member and a fixing plate to be connected to the magazine frame of the present invention.

Further referring to FIG. 3, a connection portion 32 extends from the handle 3 and a groove 322 is defined in an bottom of the connection portion 32 so that an L-shaped wrench 91 is received in the groove 322. The L-shaped wrench 91 can disassemble parts of the power stapler and occupies a very limited space.

A magazine frame 41 extends from the connection portion 32 and has a passage 310 defined therein. A magazine 4 is connected between the magazine frame 41 and the barrel 21. A fixing plate 33 is received in the passage 310 and has a first slot 330 defined longitudinally therethrough. A second slot 311 is defined through the magazine frame 31 and communicates with the second slot 311. Referring to FIGS. 3 to 7, a U-shaped guide member 36 has a flat portion with two wings extending from the flat portion, a bolt 35 extending through a hole 360 in the flat portion of the guide member 36, the second slot 311 and the first slot 330 and being engaged with a nut 34. Two insertions 361 extend from the flat portion of the guide plate 36 and the two insertions 361 are engaged with a periphery defining the second slot 311 when threading the bolt 35. Therefore, when loosening the bolt 35, the guide member 36 can be moved along the second slot 311.

Figure 2:
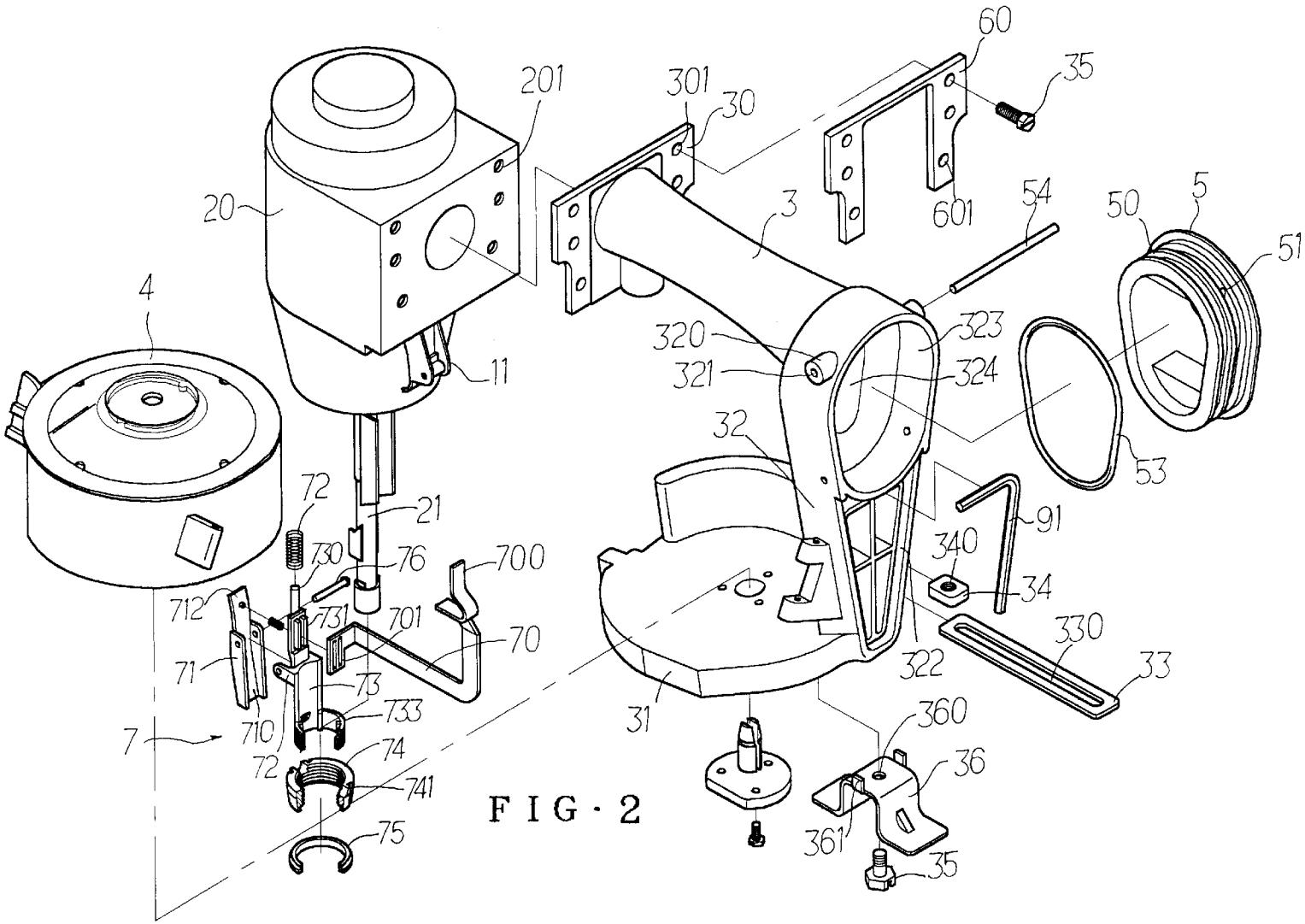
FIG. 2 is an exploded view to show a power stapler of the present invention.
Figure 11:
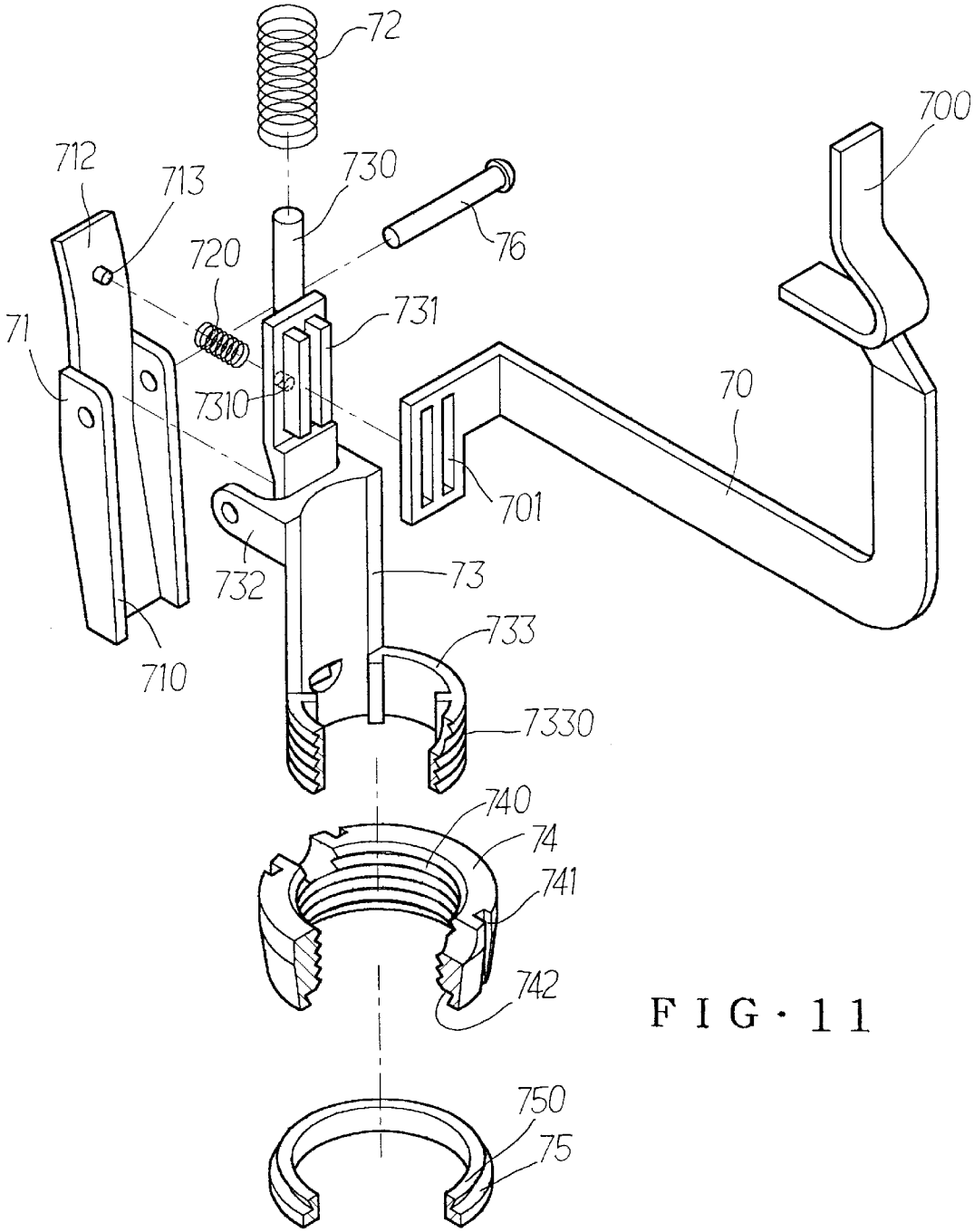
FIG. 11 is an exploded view to show a safety device of the present invention.
Figure 1:
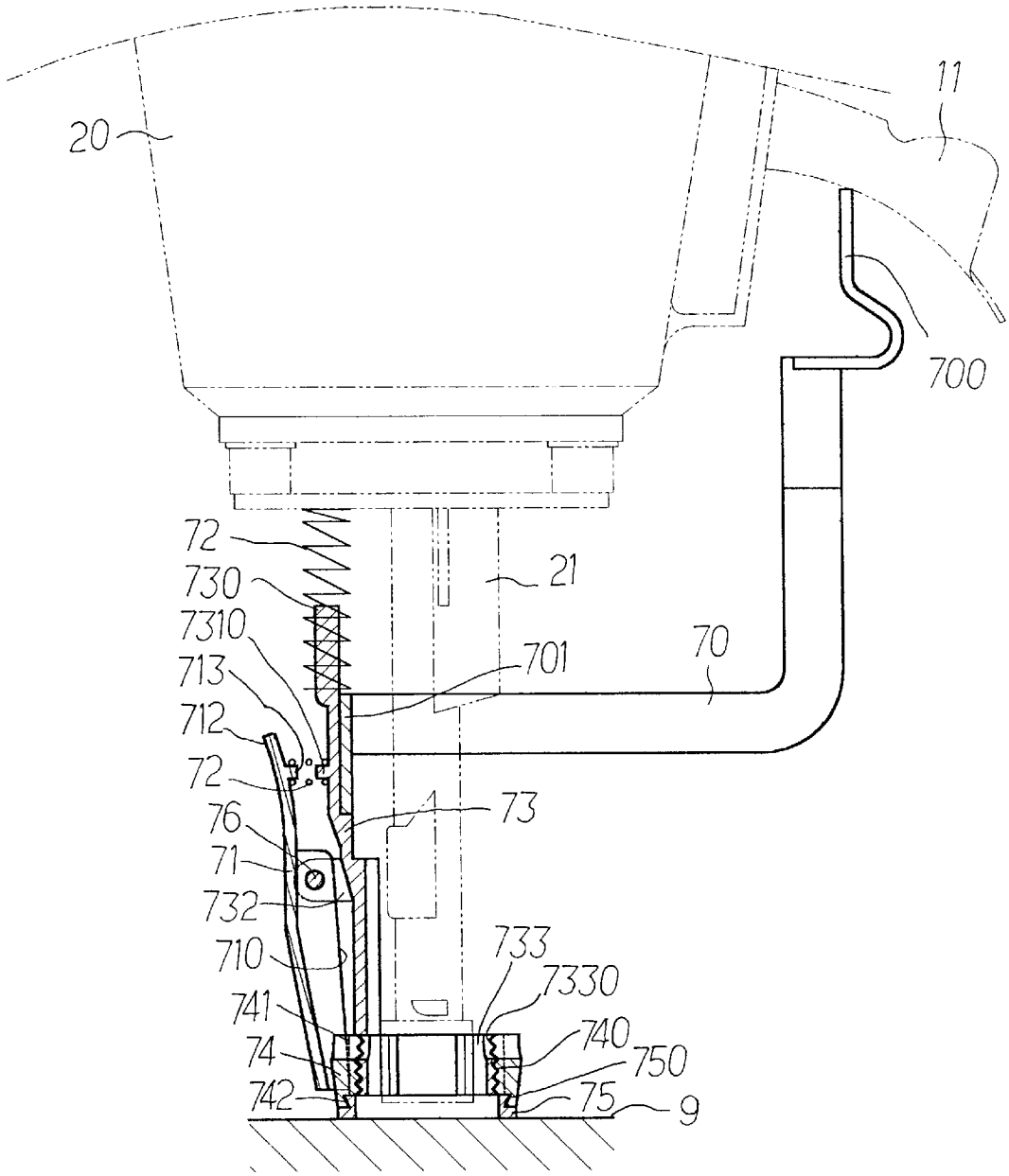
Figure 13:
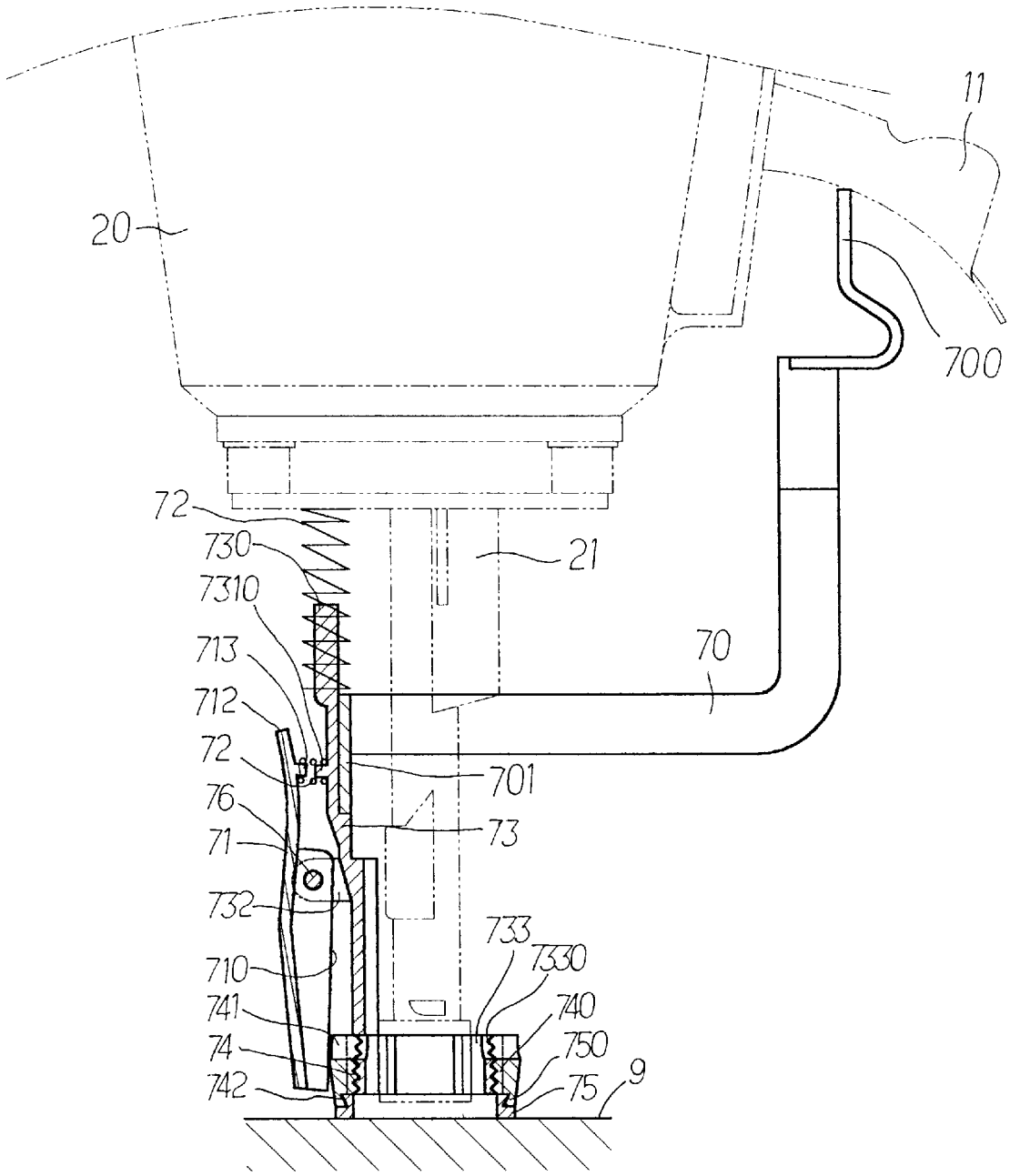
FIG. 13 is a cross sectional view to show a retaining member of the safety device is pushed before adjusting the collar on the safety device of the power stapler of the present invention.
Figure 14:
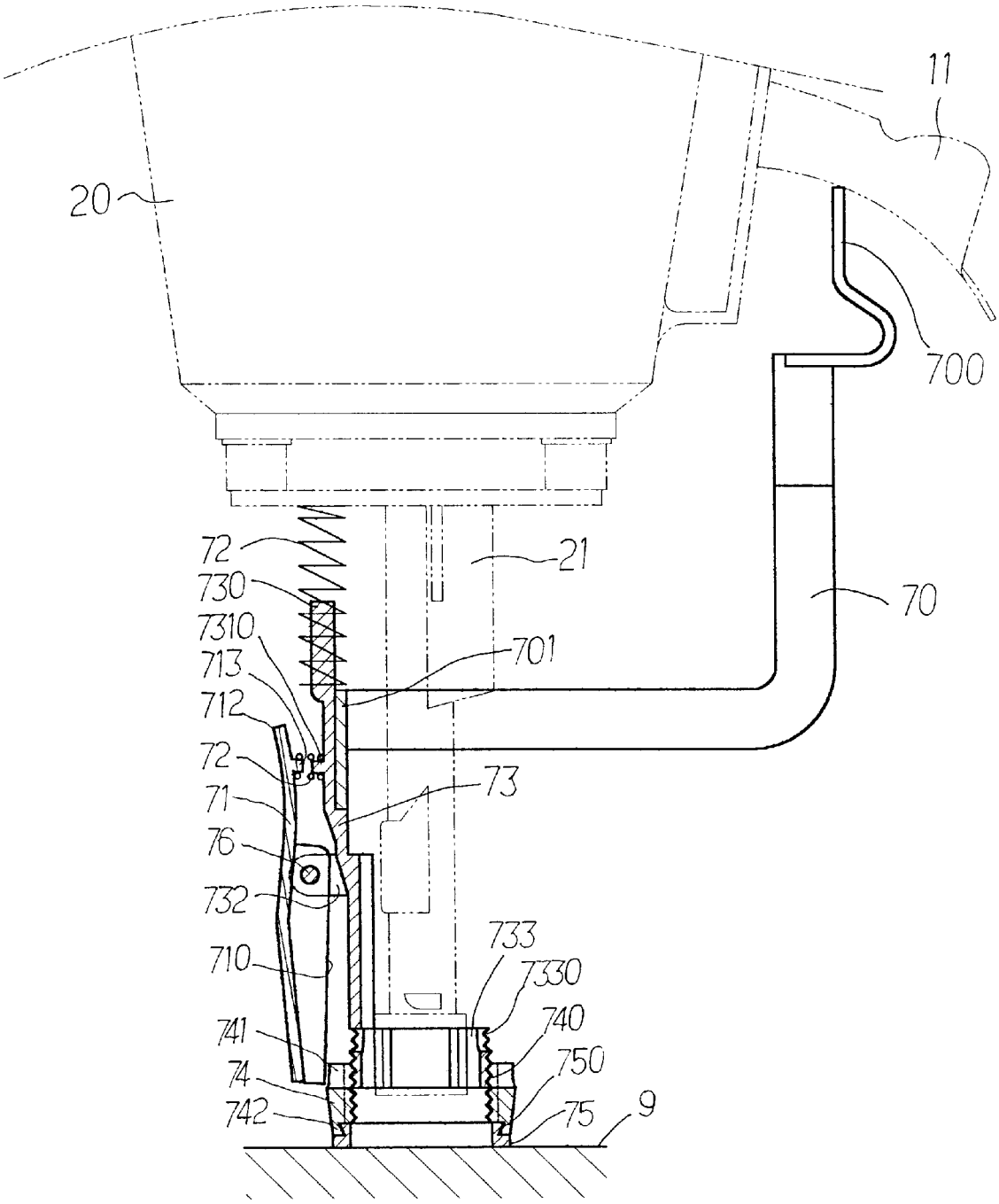
FIG. 14 is a cross sectional view to show the retaining member of the safety device is pushed and the collar on the safety device is rotated.
Figure 15:
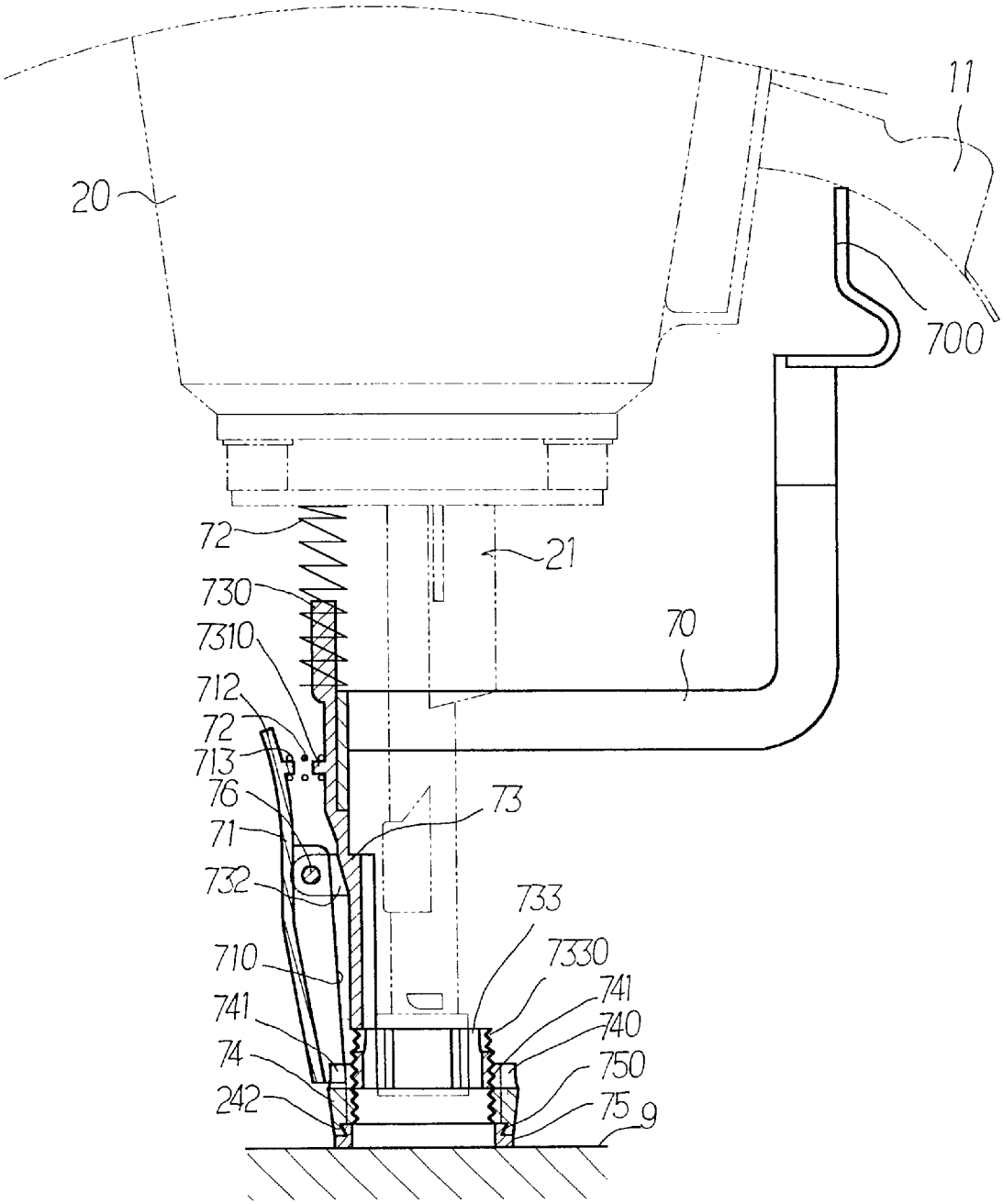
FIG. 15 is a cross sectional view to show the retaining member of the safety device is released when the collar is moved to a desired position.
Figure 17:
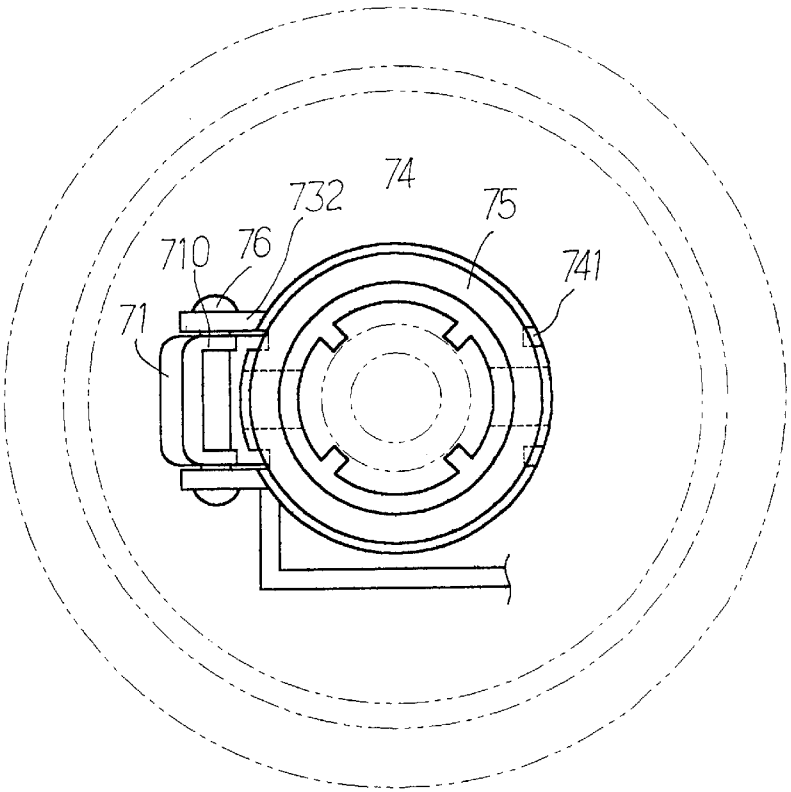
FIG. 17 shows that two retaining plates on the retaining member are removed from two notches in the collar.
Figure 16:
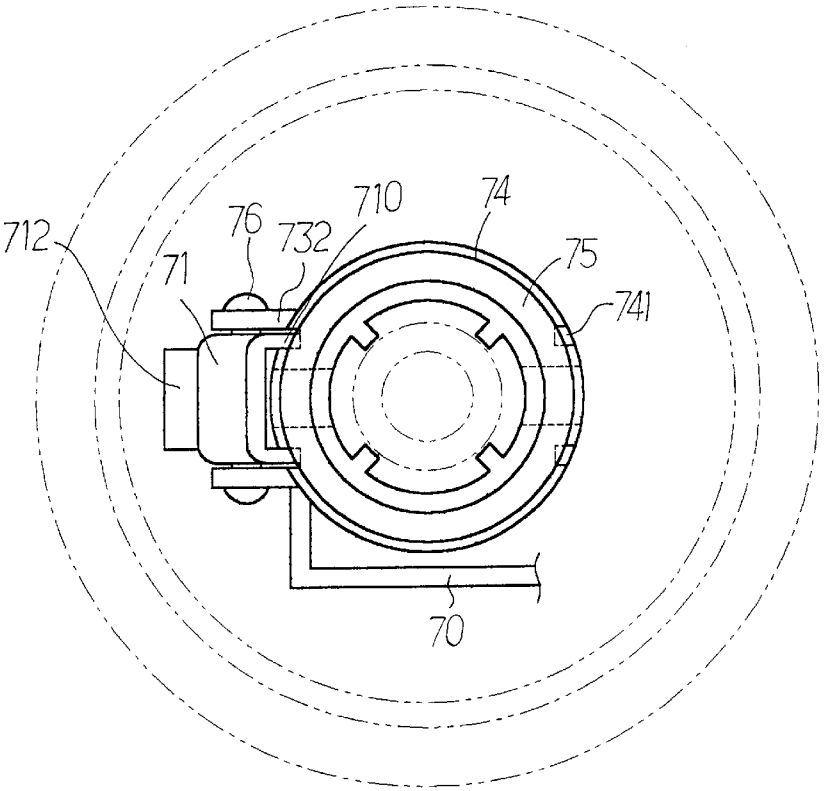
FIG. 16 shows that two retaining plates on the retaining member are not yet removed from two notches in the collar.
Figure 18:
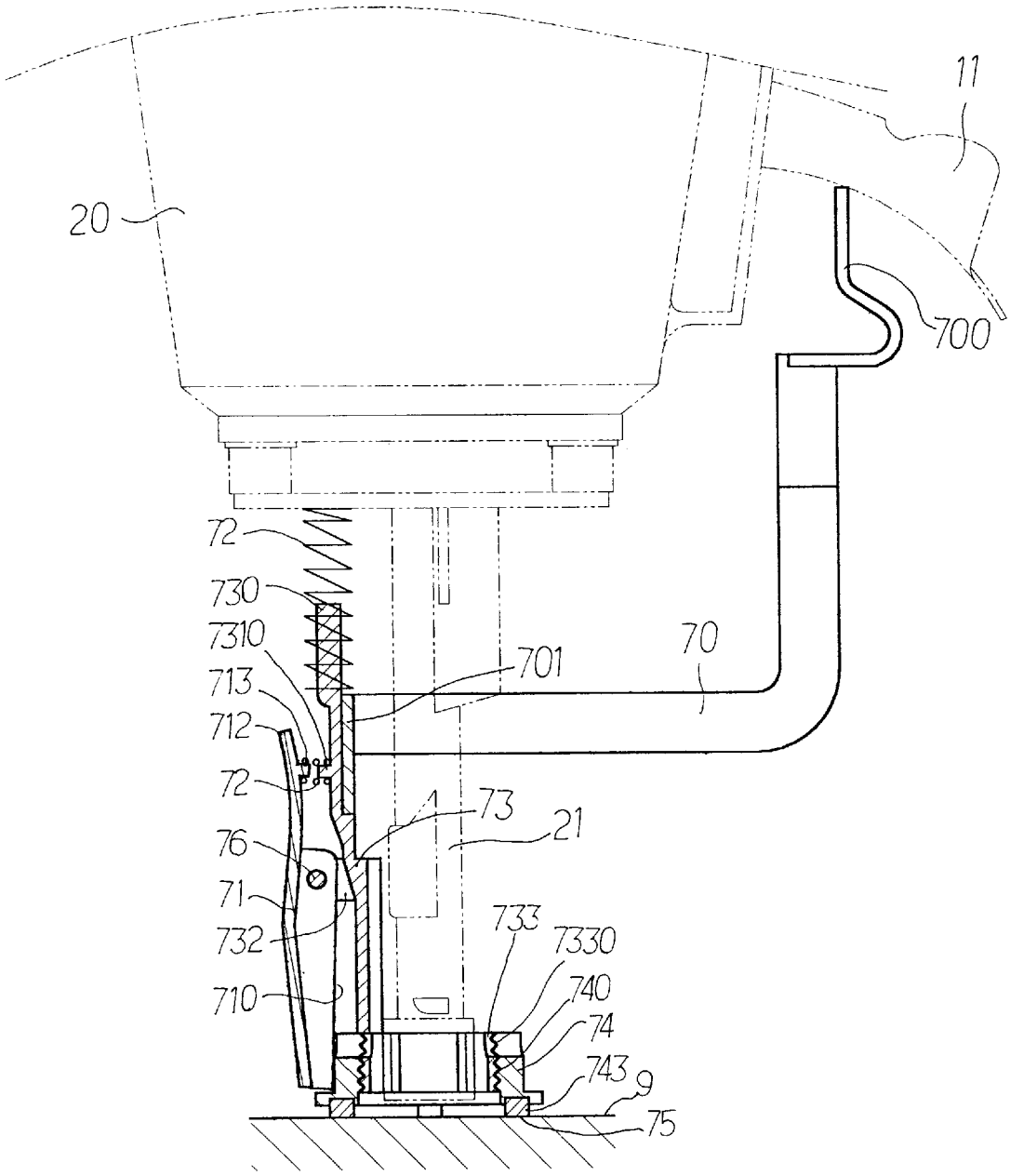
FIG. 18 shows another embodiment of the engagement between a cushion ring and the collar.

Referring to FIGS. 2 and 11, the safety device 7 is connected to the barrel 21 and includes a base member 73 wherein a first end of the base member 73 has a rod 730 so that a spring 72 is mounted to the rod 730 and biased between the body 20 and the first end of the base member 73. A ring 733 is connected to a second end of the base member 73 and the ring 733 has a threaded outer periphery 7330. A collar 74 is movably threadedly connected to the ring 733 by an inner threaded periphery 740. A dove-tailed groove 742 is defined in an inner periphery of the collar 74 and a cushion ring 75 has a dove-tailed flange 750 which is engaged with the dove-tailed groove 742. The cushion ring 75 is made of soft material so as to absorb vibration when ejecting nails in the magazine 4 from the barrel 21. Referring to FIG. 18, another embodiment for installing the cushion ring 75 is that a groove 243 is defined in an end surface of the collar 74 and the cushion ring 75 is engaged with the groove 243. Two lugs 732 extend from the base member 73 and a retaining member 71 having two retaining plates 710 is pivotally connected to the two lugs 732 by a pin 76. A protrusion 713 extends from an underside of an end of the retaining member 71 and an other protrusion 7310 extends from the base member 73 so that a spring 720 is biased between the two protrusions 713 and 7310. Two ribs 731 extend from the base member 73 and an end of the link 70 has two engaging slots 701 defined therethrough. The two ribs 731 are securely engaged with the two engaging slots 701. The collar 74 has two notches 741 defined in an outside thereof and the retaining plates 710 are engaged with the two notches 741 of the collar 74, so that the collar 74 cannot be rotated unless the two retaining plates 710 are disengaged from the notches 741 as shown in FIG. 12.

Figure 5:
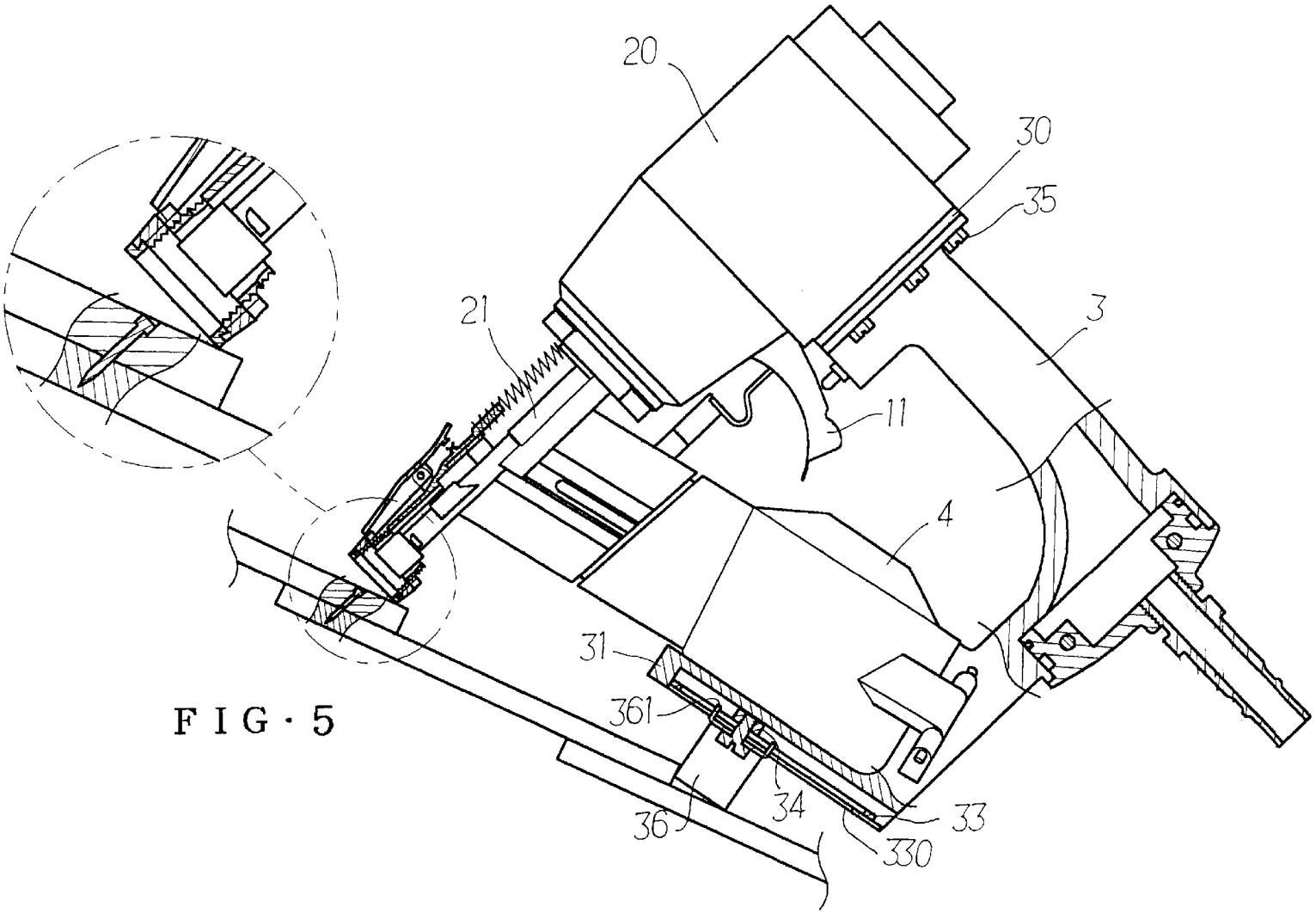
FIG. 5 is an illustrative view to show how the guide member is used to position the power stapler of the present invention.
Figure 6:
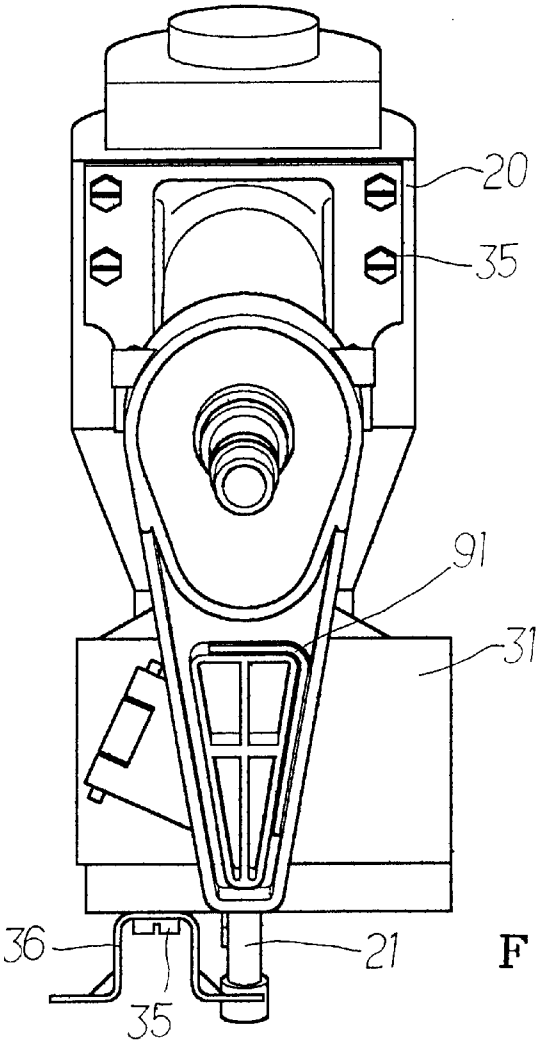
FIG. 6 is a bottom view to show the guide member on the power stapler of the present invention.
Figure 7:
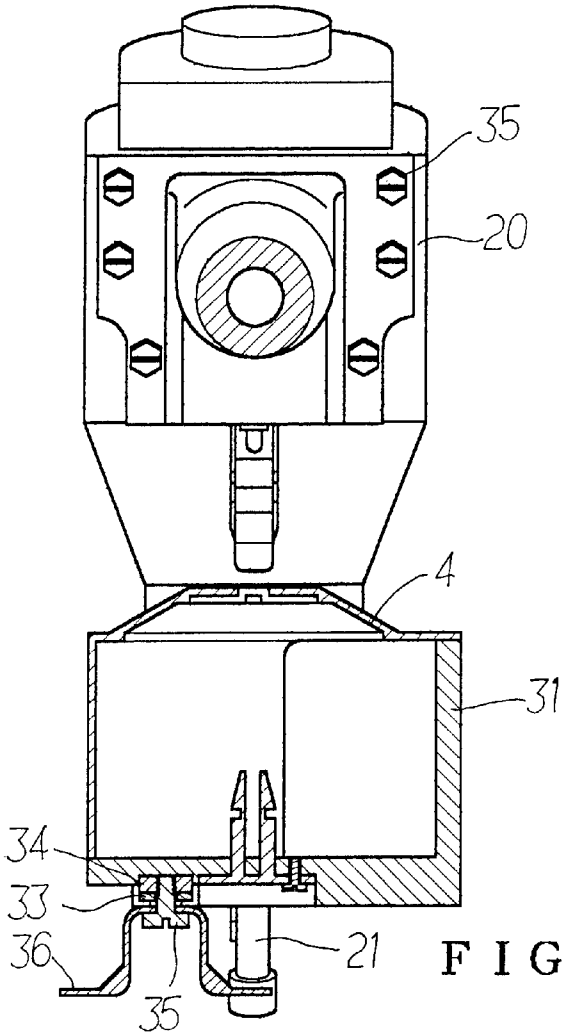
FIG. 7 is a cross section viewed from the bottom to show the guide member on the power stapler of the present invention.

When using the stapler, as shown in FIG. 12, the cushion ring 75 is pushed against an object 9 so that an actuating plate 700 on a distal end of the link 70 is moved to contact the trigger means 11 to let the trigger means 11 be a ready status. As shown in FIG. 5, the guide member 36 can be used to contact the object 9 to let the stapler firmly positioned. The guide member 36 may also be used to touch a stepped object as a distance reference point to let a distance between any two adjacent nails is the same.

Referring to FIGS. 13 to 17, when adjusting the collar 74, the retaining member 71 is pushed to compress the spring 720 and the two retaining plates 710 are removed from the two notches 741 in the collar 74. The collar 74 is then rotated till the two notches 741 are positioned in alignment with the two retaining plates 710. The retaining member 71 is released to let the retaining plates 710 engaged with the two notches 741 again. Therefore, the distance between the object 9 to the barrel 21 is adjusted.

While we have shown and described various embodiments in accordance with the present invention, it should be clear to those skilled in the art that further embodiments may be made without departing from the scope and spirit of the present invention.

What is claimed is:

1. A power stapler comprising:

a body with a barrel extending therefrom and a trigger means connected to said body, a handle connected to said body and a magazine connected between said handle and said barrel, and a safety device connected to said barrel and having a base member, a spring biased between said body and a first end of said base member, a ring connected to a second end of said base member, a collar movably connected to said ring, two lugs extending from said base member, a retaining member having two retaining plates extending therefrom and said retaining plates pivotally connected to said two lugs, a spring biased between an end of said retaining member and said base member, said collar having two notches defined in an outside thereof and said retaining plates engaged with said two notches of said collar, a link connected to said base member and contacting said trigger means.

2. The power stapler as claimed in claim 1 further comprising a cushion ring connected to said collar.

3. The power stapler as claimed in claim 2 further comprising a dove-tailed groove defined in an inner periphery of said collar, said cushion ring having a dove-tailed flange which is engaged with said dove-tailed groove.

4. The power stapler as claimed in claim 2 further comprising a groove defined in an end surface of said collar and said cushion ring engaged with said groove.

5. The power stapler as claimed in claim 1 further comprising two ribs extending from said base member and an end of said link having two engaging slots defined therethrough, said two ribs securely engaged with said two engaging slots.

6. A power stapler comprising:

a body with a barrel extending therefrom and trigger means connected to said body, a handle connected to said body and a magazine connected between said handle and said barrel, and a safety device connected to said barrel and having a base member, a spring biased between said body and a first end of said base member, a ring connected to a second end of said base member, two ribs extending from said base member and a collar movably connected to said ring, a link having two engaging slots defined therethrough and said two ribs securely engaged with said two engaging slots and contacting said trigger means.

7. The power stapler as claimed in claim 6 further comprising a cushion ring connected to said collar.

8. The power stapler as claimed in claim 7 further comprising a dove-tailed groove defined in an inner periphery of said collar, said cushion ring having a dove-tailed flange which is engaged with said dove-tailed groove.

9. The power stapler as claimed in claim 7 further comprising a groove defined in an end surface of said collar and said cushion ring engaged with said groove.

10. The power stapler as claimed in claim 6 further comprising two lugs extending from said base member, a retaining member having two retaining plates extending therefrom and said retaining plates pivotally connected to said two lugs, a spring biased between an end of said retaining member and said base member, said collar having two notches defined in an outside thereof and said retaining plates engaged with said two notches of said collar.

* * * * *